US011325746B2

(12) United States Patent
Kuhn et al.

(10) Patent No.: US 11,325,746 B2
(45) Date of Patent: May 10, 2022

(54) PALLET CONTAINER FOR THE TRANSPORT OF TEMPERATURE-SENSITIVE PRODUCTS

(71) Applicant: va-Q-tec AG, Würzburg (DE)

(72) Inventors: Joachim Kuhn, Wuerzburg (DE); Fabian Eschenbach, Rottendorf (DE); Lukas Kratsch, Wuerzburg (DE); Lorenz Straub, Randersacker (DE)

(73) Assignee: va-Q-tec AG, Wurzburg (DE)

( * ) Notice: Subject to any disclaimer, the term of this patent is extended or adjusted under 35 U.S.C. 154(b) by 0 days.

(21) Appl. No.: 16/530,951

(22) Filed: Aug. 2, 2019

(65) Prior Publication Data

US 2020/0039687 A1 Feb. 6, 2020

(51) Int. Cl.

| | |
|---|---|
| ***B65D 19/12*** | (2006.01) |
| ***B65D 19/20*** | (2006.01) |
| ***B65D 90/06*** | (2006.01) |
| ***B65D 81/38*** | (2006.01) |

(52) U.S. Cl.

CPC ..... *B65D 19/20* (2013.01); *B65D 81/3813* (2013.01); *B65D 90/06* (2013.01); *B65D 2519/00184* (2013.01); *B65D 2519/00273* (2013.01); *B65D 2519/00323* (2013.01); *B65D 2519/00706* (2013.01)

(58) Field of Classification Search

CPC .... B65D 19/20; B65D 81/3813; B65D 90/06; B65D 2519/00184; B65D 2519/00273; B65D 2519/00323; B65D 2519/00706

USPC ..... 220/592.01, 592.25, 592.27

See application file for complete search history.

(56) References Cited

U.S. PATENT DOCUMENTS

| | | | | |
|---|---|---|---|---|
| 2,534,011 | A * | 12/1950 | Frye | B65D 5/3642 229/117.07 |
| 3,327,882 | A | 6/1967 | Andrews | |
| 2010/0301057 | A1* | 12/2010 | Tattam | B65D 88/528 220/592.25 |
| 2011/0248038 | A1* | 10/2011 | Mayer | B65D 81/3823 220/592.27 |
| 2018/0334105 | A1* | 11/2018 | Bryant | B60R 7/005 |

FOREIGN PATENT DOCUMENTS

| | | |
|---|---|---|
| EP | 2256065 A1 | 12/2010 |
| EP | 2876389 B1 | 1/2018 |
| GB | 2500657 A | 10/2013 |

* cited by examiner

*Primary Examiner* — Don M Anderson
*Assistant Examiner* — Elizabeth J Volz
(74) *Attorney, Agent, or Firm* — Mark Terry

(57) ABSTRACT

Pallet container 1 for the transport of temperature-sensitive products, which pallet container 1 comprises at least one side part 21, one bottom part 22, one top part 23 and one lid part 24, each having at least one vacuum insulation panel 3 disposed therein, and wherein the at least one side part 21, the bottom part 22 and the top part 23 comprise a common stop rim portion 4, at which stop rim portion 4 the lid part 24 comes to rest partially or fully circumferentially, characterized in that the pallet container 1 comprises at least one edge protection element 7 in order to distribute a load applied by a tensioning element 6.

14 Claims, 3 Drawing Sheets

PALLET CONTAINER FOR THE TRANSPORT OF TEMPERATURE-SENSITIVE PRODUCTS

CROSS-REFERENCE TO RELATED APPLICATIONS

This patent application claims priority to German utility patent application number 20 2018 104 488.5 filed Aug. 3, 2018 and titled "Pallet Container for The Transport of Temperature-Sensitive Products". The subject matter of patent application number 20 2018 104 488.5 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

BACKGROUND

Transport containers of this type provide for a slight temperature change in the interior during transport. Thanks to special insulation and heat storage techniques, an internal temperature range of 2° C. to 8° C. can be maintained for more than 96 hours during transport to all climate zones worldwide.

Prior art disclosed in EP2876389B1 describes a transport container which, due to its excellent insulating properties, is very suitable for the transport of temperature-sensitive goods. The container wall includes vacuum insulation panels (VIP) in which a main body made of a porous material is enclosed in a gas-tight manner by means of a foil. The interior is evacuated when the enclosing foil is applied. In the container wall, the vacuum insulation panels can also be arranged in several layers in order to further improve the insulating properties. It is also envisaged to dispose passive melt-storage elements in the transport container. By using cooling sources, the period in which the temperature in the interior is stable can be increased for well over 200 hours. The solution shown has proved particularly successful in the market for reusable transport containers.

A collapsible transport container from the air freight sector is described in Document EP2256065A1. The collapsed transport container can be returned for reuse in a space-saving manner. To ensure temperature-stable transport, insulation foams based on polyurethane or polystyrene are employed. The side walls are connected to each other by means of L-shaped rim portions. Thereby, part of the L-shaped portion presses the adjoining panel against the panel being provided with the L-shaped portion. By pressing the foamed panels against each other through an elastic portion, airtight closure of the transport container is achieved. A disadvantage of this technique is that the connection provides low mechanical stability due to the elastic L-shaped portion, e.g. against impacts during transport. Another disadvantage is that the insulation materials used exhibit inadequate insulating properties for many applications. Although the foamed insulating materials are appropriate for easily achieving airtight closure, airtight closure is also a disadvantage. For example, when dry ice is used as an additional cooling source, gas (air) must be able to escape from the interior to compensate for the excess pressure caused by the evaporation of the dry ice, which may otherwise destroy the container. The same applies to the compensation of pressure differences during air-freight transports.

Furthermore, a packaging container is known from prior art disclosed in U.S. Pat. No. 3,327,882A, which is closed by means of straps. From prior art disclosed in GB2500657A, it is further known as a thermally insulating packaging container which has handles in the area of the edges which can be unfolded in order to lift the packaging container from the pallet.

SUMMARY

The present invention relates to a pallet container for the transport of temperature-sensitive products according to the independent claim. The invention concerns the technical field of transport containers or transport boxes for logistic purposes in general and especially their area of application, for example for the long-distance transport of temperature-sensitive products from the fields of medicine, pharmacy or biotechnology It is the object of the invention to provide a pallet container for the transport of temperature-sensitive products, which generally overcomes the disadvantages of prior art and is particularly suitable for the application of dry ice.

The object is attained by a pallet container for the transport of temperature-sensitive products in accordance with the independent claim. Advantageous embodiments are the subject-matter of the respective subclaims.

The invention comprises a pallet container for the transport of temperature-sensitive products, wherein the pallet container comprises at least one side part, one bottom part, one top part and one lid part, each having at least one vacuum insulation panel disposed therein. The at least one side part, bottom part and top part comprise a common stop rim portion, at which stop rim portion the lid part comes to rest partially or fully circumferentially. The pallet container comprises at least one edge protection element for distributing a (lashing) load applied by a tensioning element. Due to the configuration with a stop rim portion in combination with an edge protection element, a stable pallet container is provided due to the force applied by the tensioning element, which does not create an airtight closure. In this way, a pallet container is provided which overcomes the disadvantages of prior art in terms of the airtight closure and, in particular, can be filled with dry ice.

DETAILED DESCRIPTION

Figure 1:
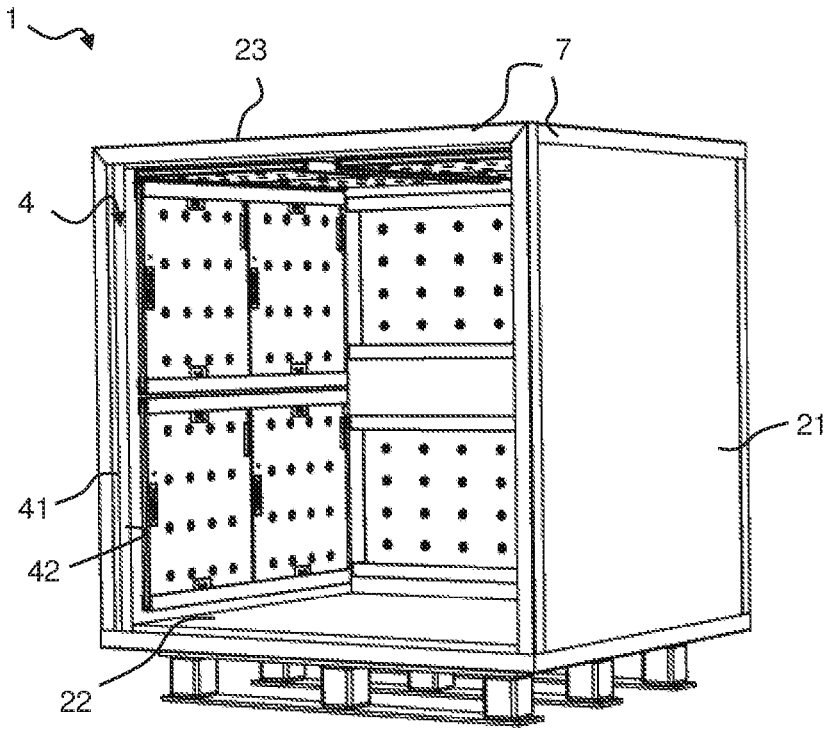
FIG. 1 shows a perspective side view of an exemplary embodiment of the pallet-container according to the invention for the transport of temperature-sensitive products.

In accordance with an advantageous technical aspect, the stop rim portion comprises a projecting fold with an inner rim portion (with the surface normal pointing inwards) against which an outer rim portion (with the surface normal pointing outwards) of the lid part comes to rest in the closed state of the pallet container. The folded configuration ensures secure positioning which prevents the lid part from slipping out of the tensioning element.

Advantageously, the side part, the bottom part, the top part and the lid part each comprise an outer cardboard layer and an inner cardboard layer, whereby the at least one vacuum insulation panel is disposed between the cardboard layers. The two cardboard layers advantageously are designed in such a way that the vacuum insulation panels are fully enclosed on the sides thereof.

According to a further technical aspect, the edge protection element comes to rest loosely against the outer cardboard layer or is firmly connected to the outer cardboard layer. The firmly embodied arrangement provides the advantage that the lid part can be handled jointly with the edge protection element, while the loose arrangement provides advantages during transport.

Another preferred aspect is that the inner cardboard layer of the lid part comprises the outer rim portion. This aspect ensures that the inner cardboard layer rests against the inner rim portion and is tensioned against the inner rim portion by a force applied by the tensioning element to the outer cardboard layer.

The outer rim portion on the lid part is preferably formed by an edge running continuously over three sides with an inwardly offset partial portion. The fourth side, without an inwardly offset partial portion, is preferably placed on the bottom part, since the entire weight rests on this wide edge when the lid is placed on it.

Another advantageous aspect is that the inner cardboard layer includes receiving elements for refrigeration elements. For example, the receiving elements can be formed by U-shaped rails which are disposed relative to each other in such a way that the refrigeration elements can be inserted between them.

Advantageously, the edge protection element is made of cardboard or plastic. Both materials make it possible to realize a rigid configuration of the edge protection element and are comparatively inexpensive to manufacture.

Particularly preferably, the tensioning element is configured as a length-adjustable tensioning belt or an elastic strap. The elastic strap, for example, can be made of a rubber material.

In accordance with an advantageous aspect, the pallet container comprises three (separate) adjacently disposed side parts. The separate side parts can be transported compactly stacked for transport and, thanks to the combination of edge protection element and tensioning element, are provided with a good connection for use during transport.

In the following, the invention will be explained in more detail using the examples shown in the attached figures.

FIG. 1 shows a pallet container 1 for the transport of temperature-sensitive products in a perspective view.

In the example shown, the pallet container 1 has three side parts 21 (respectively two side parts on the right/left and one rear part), a bottom part 22 and a top part 23. The pallet container 1 is shown open, i.e. without the lid part.

On the opened side, two opposite side parts 21, the bottom part 22 and the top part 23 have a common fully circumferential stop rim portion 4. When the pallet container 1 is closed, the lid part comes to rest firmly against the stop rim portion 4. The stop rim portion 4 has a projecting fold 41 projecting from the outer side with an inner rim portion 42.

When the pallet container 1 is in the closed state, a complementarily embodied outer rim portion (see FIG. 2) of the lid part rests against the inner rim portion 42. Due to the configuration with a stop rim portion 4 in combination with an edge protection element 7 and a tensioning element 6 (see FIG. 4), both a stable pallet container 1 is provided and an air-permeable closure is created, for which reason the disadvantages of prior art with regard to the air-tight closure, in particular with regard to the use of dry ice, do not occur.

Figure 3:
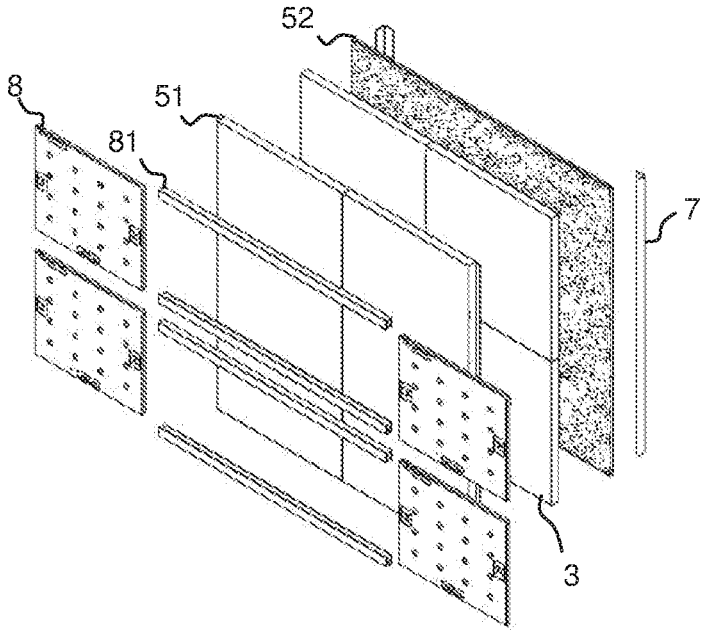
FIG. 3 shows an exploded view of the structure of a side part, bottom part, top part or lid part for the pallet container according to FIG. 1.

The pallet container 1 at each edge thereof has an edge protection element 7 made of cardboard (in the example shown) extending over the entire edge. The edge protecting elements 7 may be mitered at the end portion. In the example shown, the edge protection element 7 is glued on respectively one side to the respective outer side (outer cardboard layer 52; FIG. 3).

The pallet container 1 is designed as a pallet on the underside thereof in such a way that fork tools of a forklift truck can be inserted.

Figure 2:
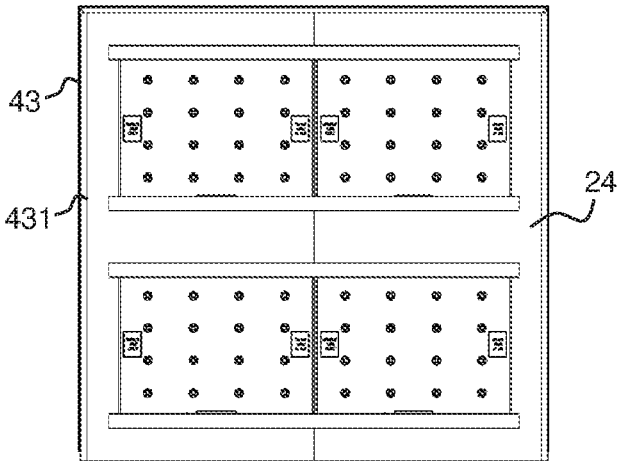
FIG. 2 shows a side view of a lid part for the pallet container according to FIG. 1.

FIG. 2 shows a lid part 24 as it can be placed on the opening of the pallet container according to FIG. 1. When the pallet container is in the closed state, the outer rim portion 43 of the lid part 24 comes to rest against the inner rim portion of the side part and the top part. For this purpose, an edge running continuously over three sides is formed on the outer rim portion 43 of the lid part 24 with an inwardly offset partial portion 431.

FIG. 3 shows an exploded view of the basic structure of a side part, bottom part, top part or lid part using the example of a side part for the pallet container according to FIG. 1.

As seen from the left to the right, the structure comprises refrigeration elements 8 with fastening profiles 81, an inner cardboard layer 51, four vacuum insulation panels 3, an outer cardboard layer 52 and edge protection elements 7.

Between the outer cardboard layer 52 and the inner cardboard layer 51 the vacuum insulation panels 3 are arranged in such a way that they are laterally enclosed by the inner cardboard layer 51. The inner cardboard layer 51 comprises the outer rim portion 43 at the lid part. The receiving elements 81 for refrigeration elements 8 are attached to the inner cardboard layer 51.

Figure 4:
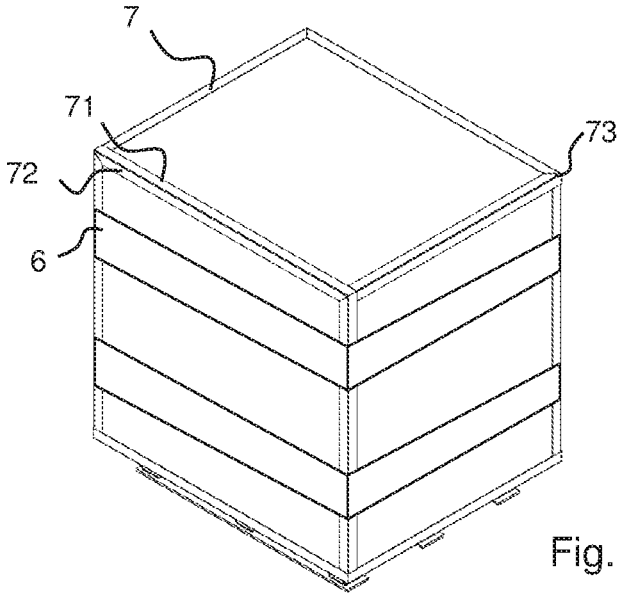
FIG. 4 shows a perspective side view of the pallet container according to FIG. 1 in the closed state.
Figure 5:
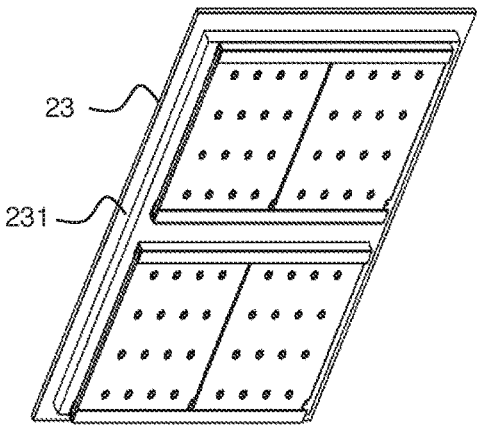
FIG. 5 through 8 show a perspective side view of an exemplary embodiment of a first and second side part as well as the bottom part and the top part of the pallet container according to FIG. 1.
Figure 6:
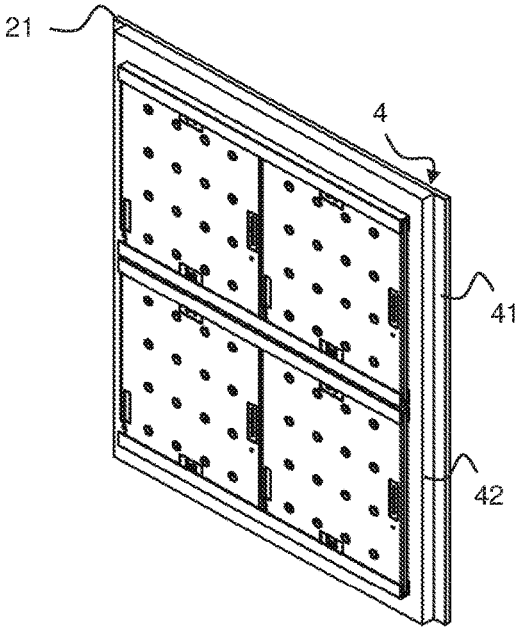
Figure 7:
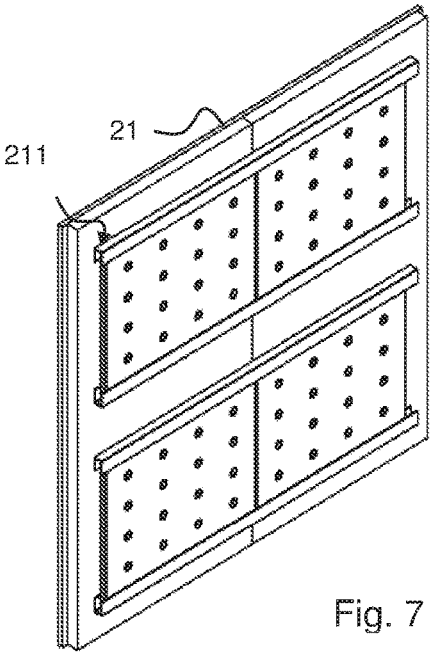
Figure 8:
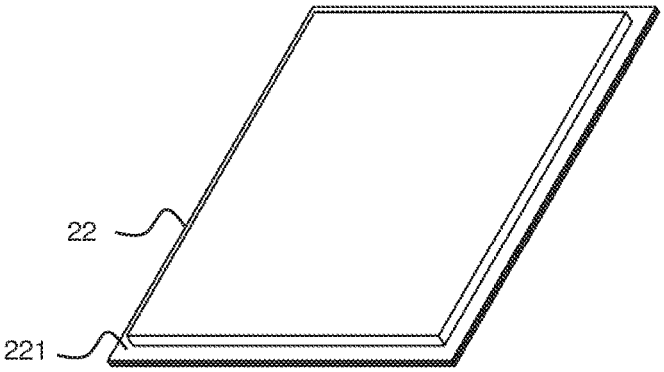

The closed pallet container is shown in FIG. 4. Thereby, the lid part according to FIG. 1 is placed on the opening of the pallet container according to FIG. 1. In the example shown, two tensioning elements 6 are arranged one above the other in the form of a tensioning belt.

The respective parts of the pallet container described above without lid part can be seen again in detail in FIG. 5 to FIG. 8, so that the construction of the pallet container becomes clear. The top part 23 has a circumferential rim 231, the width of which corresponds to the thickness of the side parts 21 (respectively two side parts in FIG. 6 and one rear part in FIG. 7). The bottom part 22 (FIG. 8) has an identical rim 221. The side parts 21 in FIGS. 6 and 7 have a stop rim portion 4 against which the lid part (further side part) comes to rest firmly. The stop rim portion 4 has a projecting fold 41 projecting from the outer side with an inner rim portion 42.

What is claimed is:

1. Pallet container for the transport of temperature-sensitive products, which pallet container comprises at least one side part, one bottom part, one top part and one lid part, each having at least one vacuum insulation panel disposed therein, and wherein the at least one side part, the bottom part and the top part comprise a common stop rim portion, against which stop rim portion the lid part comes to rest partially or fully circumferentially, characterized in that the pallet container comprises at least one edge protection element in order to distribute a load applied by a tensioning element, wherein the stop rim portion comprises a projecting fold with an inner rim portion against which an outer rim portion of the lid part comes to rest in the closed state of the pallet container.

2. The Pallet container according to claim 1, wherein the side part, the bottom part, the top part and the lid part each comprise an outer cardboard layer and an inner cardboard layer, between which the at least one vacuum insulation panel is disposed.

3. Pallet container according to claim 2, wherein the edge protection element comes to rest loosely against the outer cardboard layer or is firmly connected to the outer cardboard layer.

4. Pallet container according to claim 2, wherein the inner cardboard layer of the lid part includes the outer rim portion.

5. Pallet container according to claim 2, wherein the inner cardboard layer comprises receiving elements for refrigeration elements.

6. Pallet container according to claim 1, wherein the outer rim portion on the lid part is formed by an edge running continuously over three sides with an inwardly offset partial portion.

7. Pallet container according to claim 1, wherein the edge protection element is made of cardboard or plastic.

8. Pallet container according to claim 1, wherein the tensioning element is a length-adjustable tensioning belt or an elastic strap.

9. Pallet container according to claim 1, having three unitary or separate side parts being disposed adjacent to one another.

10. Pallet container according to claim 1, wherein the edge protection element has a length corresponding to a side length of the pallet container.

11. Pallet container according to claim 1, wherein the edge protection element is configured in one piece or in multiple pieces, and wherein the edge protection element completely encloses at least one side of the pallet container.

12. Pallet container according to claim 1, wherein the edge protection element includes two portions being arranged at right angles to one another.

13. Pallet container according to claim 12, wherein the two portions being arranged at right angles to one another have a width in the range from 3 cm to 15 cm.

14. Pallet container according to claim 1, wherein the edge protection member is cut at least one end portion at an angle in the range of 15° to 100° with respect to a longitudinal axis of the edge protection member.

* * * * *